United States Patent [19]

Suzuki et al.

[11] Patent Number: 4,490,171

[45] Date of Patent: Dec. 25, 1984

[54] METHOD AND APPARATUS FOR INJECTING PULVERIZED FUEL INTO A BLAST FURNACE

[75] Inventors: Tomio Suzuki, Kobe; Setsuo Tamura, Nishinomiya; Kozo Tanaka, Miki; Ryoichi Hirose; Hiroyuki Komatsu, both of Kobe; Shinichi Tamada, Himeji; Taketsugu Kasai, Kobe; Keisuke Tanimoto, Fujiidera, all of Japan

[73] Assignee: Kobe Steel, Limited, Kobe, Japan

[21] Appl. No.: 477,489

[22] Filed: Mar. 21, 1983

[30] Foreign Application Priority Data

| | | | |
|---|---|---|---|
| Mar. 31, 1982 | [JP] | Japan | 57-54231 |
| Mar. 31, 1982 | [JP] | Japan | 57-47172[U] |
| Mar. 31, 1982 | [JP] | Japan | 57-47169[U] |
| Mar. 31, 1982 | [JP] | Japan | 57-54230 |

[51] Int. Cl.[3] ..... C21B 7/16

[52] U.S. Cl. ..... 75/42; 266/267; 266/182; 266/188

[58] Field of Search ..... 75/42; 266/267, 182, 266/188

[56] References Cited

U.S. PATENT DOCUMENTS

| | | | |
|---|---|---|---|
| 3,207,597 | 9/1965 | Hashimoto et al. | 75/42 |
| 3,209,810 | 10/1965 | Schuvart . | |
| 3,366,469 | 1/1968 | Kodama et al. | 75/42 |
| 3,558,119 | 1/1971 | Demalander | 75/42 |
| 3,596,894 | 8/1971 | Duthion | 75/42 |
| 3,920,230 | 11/1975 | Murphy | 266/188 |
| 3,971,654 | 7/1976 | Mancke | 75/42 |

FOREIGN PATENT DOCUMENTS

| | | | |
|---|---|---|---|
| 44096 | 1/1982 | European Pat. Off. | 266/267 |

OTHER PUBLICATIONS

E. M. Summers, et al., Coal Injection into No. 5 Blast Furnace at Stanton and Staveley Ltd., May 22, 1963.

S. Garber, Ph.D., Recent Developments in Annealing, May 22, 1983.

J. H. Strassburger, et al., Solid Fuel Injection at the Hanna Furnace Corporation.

Solid Fuel Injection System No. 4 Blast Furnace Weirton Steel Company, Jun. 20, 1963.

*Primary Examiner*—M. J. Andrews

*Attorney, Agent, or Firm*—Oblon, Fisher, Spivak, McClelland & Maier

[57] ABSTRACT

A method for injecting a pulverized fuel into a blast furnace uses a pulverulent fuel injecting burner which is protruded into a blow pipe through a wall thereof near the tuyere of a blast furnace. The burner injects a pulverized fuel into the blast furnace along with a hot blast of air at a temperature higher than 950° C. flowing through the blow pipe. The tip end of the burner is located at a distance L between 100 and 350 mm upstream from the boundary between the tuyere of the blast furnace and the blow pipe. According to one embodiment, the tip of the furnace is tapered by an angle $\theta \leqq 1400L^2 - 1290L + 295$. According to a second embodiment, the inner diameter $B_1$ of the blow pipe, and the inner and outer diameters of the burner tip (d and D) are selected such that $0.1 \leqq (D/Bi) \leqq 0.25$ and $0.6 \leqq (d/D) \leqq 0.8$. According to a third embodiment, the burner tip is removable.

28 Claims, 12 Drawing Figures

METHOD AND APPARATUS FOR INJECTING PULVERIZED FUEL INTO A BLAST FURNACE

BACKGROUND OF THE INVENTION

1. Field of the Invention

This invention relates to a method and apparatus for injecting a pulverized fuel, which is generally regarded as being inferior to fluid fuels in combustibility. More particularly, the invention concerns a method and apparatus for injecting such pulverized fuels in an optimum condition, which can improve combustibility while avoiding ash deposition (accumulation on the inner surfaces of the blow pipe), as a result of the improved combustion of the fuel.

This invention also relates to a burner for injecting a pulverized fuel, which is generally regarded as being inferior to fluid fuels in combustibility. More particularly, the invention concerns a burner for injecting such pulverized fuels in an optimum condition, which can improve combustibility while avoiding ash deposition as a result of the improved combustion of the fuel.

2. Description of the Prior Art

As a result of increases in petroleum cost, it has become popular for a blast furnace to rely on an all-coke operation rather than injection of heavy oil.

Research and studies are currently under way on ways to lessen the difficulties of the all-coke operation and to inject a pulverized fuel such as fine coal powder or the like to reduce the consumption of costly coke. However, the pulverized fuel, such as fine coal or the like, (hereinafter referred to generally as "pulverized fuel") has drawbacks in that it has a low combustion rate as compared with heavy oil and contains incombustible components which produce ashes. Therefore, it requires countermeasures in the injecting operation as will be described more particularly hereinbelow.

In a conventional heavy oil injection operation, the tip end of a burner is located in the vicinity of the boundary between a tuyere of a blast furnace and a blow pipe so as to burn the injected fuel completely in a race way immediately downstream of the tuyere. However, if a pulverized fuel is injected at the same position, it will become difficult to burn the pulverized fuel completely within the tuyere and race way, resulting in a lower combustion efficiency.

On the other hand, the pulverized fuels have an ash content, which is fused by the combustion heat and tends to deposit or accumulate on the inner surfaces of the blow pipe upon collision thereagainst, narrowing the blow passage and making it difficult to continue a stable fuel injecting operation. This problem is coupled with the possibility of the ash deposit destabilizing the hot air blowing through the tuyere. The amount of ash deposition or accumulation increases if the injecting position is located in a more upstream position.

SUMMARY OF THE INVENTION

Based on the foregoing findings, the present inventors conducted intensive research with a view to enhancing the combustion efficiency of the pulverized fuel to a level comparable to liquid fuel while preventing ash deposition or accumulation. The invention has been attained as a result of such research, and resides in a method of injecting a pulverized fuel into a blast furnace, using a pulverized fuel injection burner protruded into a hot air blow pipe through a wall thereof at an injecting portion of the blast furnace. The tip end of the burner is located at a position in the vicinity of the axis of the blow pipe so as to inject a pulverized fuel into the blast furnace at the tuyere along with hot air at a temperature higher than 950° C. flowing through the blow pipe. According to the invention, the tip end of the burner is located at a position 100–350 mm upstream of the boundaries between the tuyere of the blast furnace and the blow pipe.

Since a gas has weak cooling effect in the case of a solid/gas dual phase flow, it is necessary to select a heat resistant material for the burner which is exposed to the hot blast in the blow pipe or to add a cooling structure or other coutermeasures.

The inventors initially considered a cooling structure in a burner of multiple cylinder construction. Such a burner necessarily has a large outer diameter due to the provision of a passage for a cooling medium around the passage for the pulverized fuel, giving rise to problems as will be discussed below. Referring to FIG. 6 there is shown in section a burner having a triple cylinder construction for the purpose of water cooling. The burner has an inner cylinder 21, an intermediate cylinder 22 and an outer cylinder 23. The inner and outer cylinders 21 and 23 are integrally connected with each other by a sectional U-shaped, semi-circular cap 24, thus forming a passage for solid/gas dual phase fuel flow in the arrowed direction through the inner cylinder 21 while forming a passage for a cooling medium between the inner and intermediate cylinders 21 and 22 and between the intermediate and outer cylinders 22 and 23 as indicated by the arrowed broken lines. As the solid/gas dual phase fuel flow which consists of a pulverized fuel and a carrier gas, is injected from the outlet at the fore end of the burner, it is entrained in the surrounding high velocity hot air blast and is thereby ignited to undergo combustion. Since the burner itself has a large outer diameter, a relative vacuum zone occurs in a pocket 26 between the jet flow of fuel 25 and the cap 24, forming vortexes 27. As the jet flow 25 expands under these circumstances, the flame contacts the inner surface of the blow pipe 10, causing part of the ash which is fused by the heat of the flame to be deposited and accumulate thereon. This works as a negative factor, off-setting any high combustibility which may be attained by the positioning of the pulverized fuel injecting end of the burner.

In light of the above, the present invention has as an object the provision of the burner which is provided with a water or air cooling structure and which can suppress the flame expansion to a minimum.

The burner of the present invention which can attain the above-mentioned object has a multiple cylinder construction with an inner cylinder providing a passage for a pulverized fuel forming a solid/gas dual phase flow and an outer cylinder providing a passage for a cooling medium. The burner has at the fore end thereof a tapered outer configuration satisfying the following equations:

$$\theta \leqq 1400L^2 - 1290L + 295$$

$$0.1 \leqq L \leqq 0.35$$

The tip end of the burner is located in a position in the vicinity of the axis of the blow pipe so as to inject a pulverized fuel into the blast furnace at the tuyere along with hot air flowing through the blow pipe. According to the invention, the tip end of the burner is located at a position 0.1–0.35 meters (100–350 mm) upstream of the boundaries between the tuyere of the blast furnace and the blow pipe.

The present inventors have also found that the amounts of deposition of ash differ largely depending upon the shape of the burner, particularly the shape of its fore end portion (more specifically the wall thickness of the fore end portion of the burner) even in a case where the fore end of the burner is located in a position which is most susceptible to ash deposition.

Based on the above observations, the inventors have concluded that the inner diameter (Bi) of the blow pipe, the outer diameter (D) at the tip end of the burner and the inner diameter (d) at the tip end of the burner should be held in appropriate relations in order to preclude the problem of ash deposition on the wall of the blow pipe.

More particularly, the present invention has as a further object the provision of a pulverized fuel injecting burner which has a reduced possibility of giving rise to ash deposition on the inner surface of a blow pipe in which:

$$0.1 \leqq (D/Bi) \leqq 0.25$$

$$0.6 \leqq (d/D) \leqq 0.8$$

The present invention has as a further object the provision of a burner which is provided with a water or air cooling structure and which can suppress the flame expansion to a minimum.

The burner of a third embodiment of the present invention which can attain the above-mentioned object includes a burner body proper of a multiple cylinder construction and a tip detachably attached to the fore end of the burner body. The burner body defines in a center cylinder a transfer passage for a pulverized fuel forming a solid/gas dual phase flow and in an outer cylinder a passage for a cooling medium. The tip has an inner diameter which is not smaller than the inner diameter of the center cylinder of the burner body and an outer diameter reduced toward the fore end thereof from an abutting portion in engagement with the burner body.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designated like or corresponding parts throughout the several views and wherein.

DETAILED DESCRIPTION OF THE PREFERRED EMBODIMENTS

Figure 1:
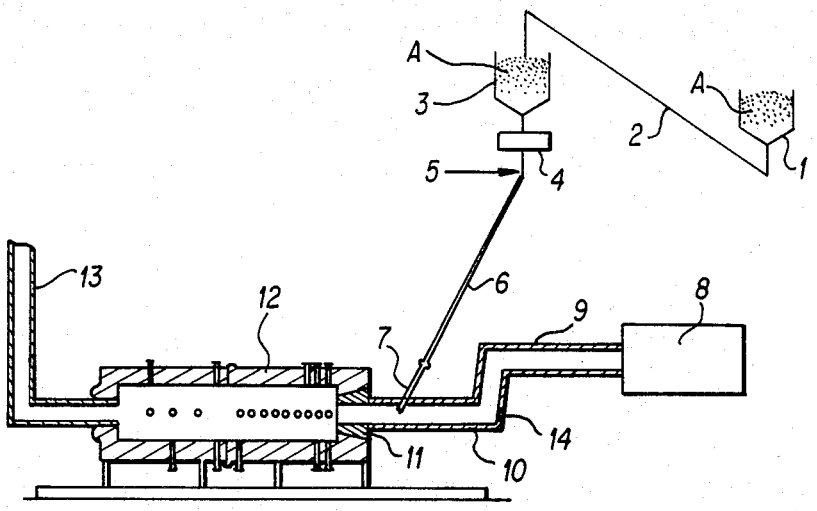
FIG. 1 is a schematic illustration of a combustion apparatus.

Referring to FIG. 1, there is schematically shown a combustion furnace in which a pulverized fuel A is transferred to a coal-bin 3 from a ground hopper 1 by means of a screw conveyer 2. The coal-bin 3 is provided with a pulverized fuel feeder 4 in its lower portion to feed a metered amount of the pulverized fuel A to a burner 7 through a feed pipe 6 via air currents 5. On the other hand, hot air which is produced by a hot blast stove 8 is fed to an experimental combustion furnace 12 from an air feed pipe 9 through a blow pipe 10 and a water-cooled tuyere 11 having a water jacket 11*c* through which cooling water flows. The reference numeral 13 denotes a stack.

Figure 2:
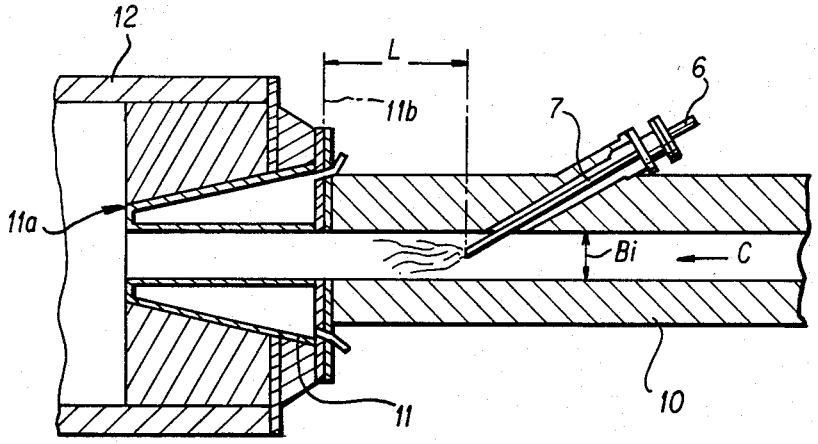
FIG. 2 is an enlarged view of major components in a pulverized fuel injecting portion of the combustion appartus of FIG. 1.

The fuel injection section of the blast furnace which consists of blow pipe 10 and water-cooled tuyere 11, differs from the known combustion apparatus. The illustrated combustion apparatus is other wise constructed similarly to the injecting section of an actual blast furnace. FIG. 2 illustrates the major components of the furnace on an enlarged scale. The experimental combustion apparatus is provided with a multitude of peep windows 12*a* to permit observation of the condition of combustion or ignition of the pulverized fuel, and an inspection hole for insertion of a probe for measuring the combustion temperature, the furnace gas composition, the amount of ash and the flame radiation in the furnace. In addition, a peep window 14 is provided in a bent portion at the upstream end of the blow pipe 10 for observing the deposition of ashes on the inner wall surfaces of the blow pipe 10.

The foregoing apparatus was used in a series of experiments which will be referred to hereinafter and which were conducted under the following condition.

Pulverized fuel: 20–45 wt % of volatile content
Fuel injection rate: 100 kg/hr
Fuel injection velocity: 10–25 Nm/sec
Transport air ratio (coal/air): 5–25 kg/kg
Hot blast air temperature: 800–1200° C.
Hot blast air pressure: 2000 mmAq
Velocity at tip end of tuyere: 250 m/sec (1200° C.)
Blow pipe diameter: 0.13–0.18 m
Furnace temperature: 1500°–2200° C.

Figure 3:
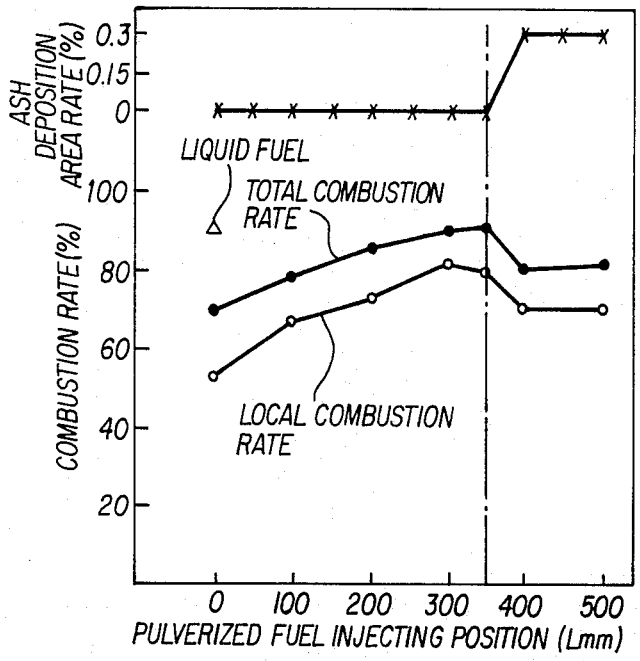
FIG. 3 is a diagram of the pulverized fuel injecting position versus the combustion efficiency and the amount of ash deposition.
Figure 4:
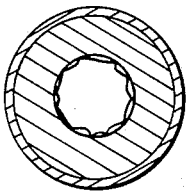
FIG. 4 is a schematic illustration of ash deposition on the inner surface of a blow pipe.

Experiments were conducted using the abovedescribed apparatus and under the foregoing conditions (with the hot blast temperature set at 1200° C.). In the experiments, the position of the burner 7 in the blow pipe 10 (the distance L of the tip end of the burner from a boundary plane or surface 11*b* of the tuyere 11 and the blow pipe 10) was varied to study the combustion efficiency and the condition of ash deposition on the inner wall surfaces of the blow pipe 10 at the respective injection positions. The results of these experiments are shown in FIG. 3 in which the combustion efficiency is expressed by way of a total combustion efficiency as calculated from the distribution of generated $CO_2$ gas concentration and velocity and a local combustion efficiency as calculated from the amount of ash in the center portion of the furnace. The $CO_2$ concentration for the calculation of the total combustion efficiency was measured at a position 0.8 m downstream (to the left in FIG. 2) of the fore end face 11*a* of the water-cooled tuyere 11, which corresponds to the depth of the race way in an actual blast furnace. Therefore, it is necessary to burn the pulverized fuel completely before reaching that position. On the other hand, the ash deposition is indicated by the amount of ash deposition at 5 hours after commencement of the experiment and constitutes the percentage of the ash deposition in the blow pipe, as seen through the peep window 14 (see FIG. 4).

As is clear from FIG. 3, the liquid fuel (heavy oil) can attain a combustion efficiency of about 92% even when the distance L is zero. In contrast, the total combustion efficiency of the pulverized fuel drops to about 70% when injected at the same position. In other words, with regard to the combustion rate, the pulverized fuel is consumed only about 76% as efficiently compared as is liquid fuel ($70/92\times100$), wasting about ¼ of the fuel in terms of the calorific value. The combustion efficiency can gradually be raised as the distance L is increased, clearly showing a significant increase when the distance L exceeds 100 mm. In the range of 300–350 mm, the combustion efficiency is improved by about 20% and to a value comparable to that of the liquid fuel.

On the other hand, the ash deposition is barely traceable in a case where the distance L is smaller than 350 mm, but it abruptly picks up if the distance L is increased beyond 350 mm. As a result, there occur reductions in the area of the hot air passage of the blow pipe 10 with a resulting trend of lowering the combustion efficiency.

Thus, in order to obtain satifactory results in both combustion efficiency and the amount of ash deposition, which are considerably influenced by the distance L, it will be understood that the distance L should be set in the range of 100–350 mm, preferably in the range of 200–350 mm.

Figure 5:
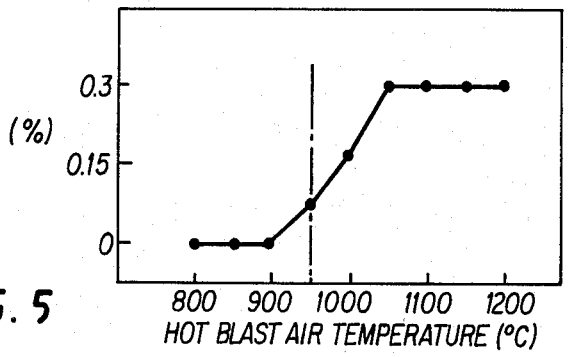
FIG. 5 is a diagram of the hot blast temperature versus the amount of ash deposition.

Referring to FIG. 5, there is plotted the relationship between the temperature of the hot blast air and the amount of ash deposition, based on the results of experiments in which the distance L was set at 400 mm and the temperature of the hot blast air was varied over a range of 800°–1200° C. As is clear therefrom the operation is almost free of ash deposition as long as the temperature of the hot blast air is below 900° C. However, if the temperature of the hot blast air is increased beyond 900° C., the ash deposition increases dramatically. This is considered to be ascribable to the influence of the melting point of the ash content of the pulverized fuel, which is presumably injected into the furnace without being melted within the blow pipe at temperatures below 900° C. It follows that the present invention is valuable in the case of hot blast higher than 950° C., particularly in the case of hot blast air higher than 1050° C. since the low temperature hot blasts air are free of the problem which the present invention is attempting to overcome.

It is conceivable that such ash deposition or accumulation might be increased by reductions in the inner diameter of the blow pipe 10, and that it can be minimized by the use of a pipe of a larger diameter, with a reduced blockage of the flow passage area by the deposited ash and a relatively small drop in the combustion efficiency. In this regard, a study of the relationship between the ash deposition and the inner diameter of the blow pipe revealed that the problem of ash deposition occurs more conspicuously in the case of blow pipes having an inner diameter smaller than 180 mm, the influence of ashes reducing the inner diameter being almost ignorable in the case of blow pipes of larger inner diameters. In this connection, the inner diameter of a pipe to be used on an actual blast furnace is restricted in order to secure a predetermined amount and velocity of hot blast, and is generally limited to about 180 mm at most. Taking these points into consideration, the present invention is significant in a case in which a blow pipe smaller than 180 mm in inside diameter is used. On the contrary, it is desired to employ a blow pipe greater than 130 mm in inside diameter since the influence of the ash deposition will become prominent with blow pipes of smaller inside diameters.

According to the present invention as described above, it becomes possible to raise the combustion efficiency of a pulverized fuel to a level comparable to that of a liquid fuel by appropriately adjusting the position of a pulverized fuel injection burner, without ash deposition.

Figure 6:
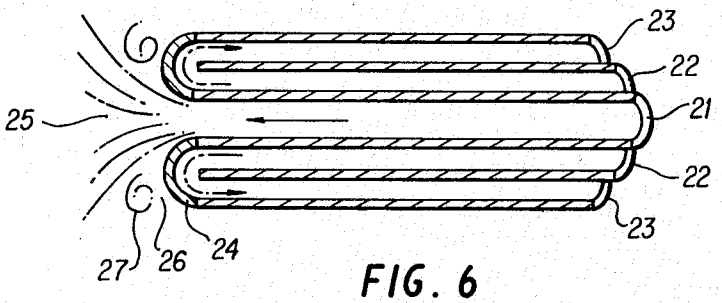
FIG. 6 is an enlarged view of the tip of a burner.
Figure 7:
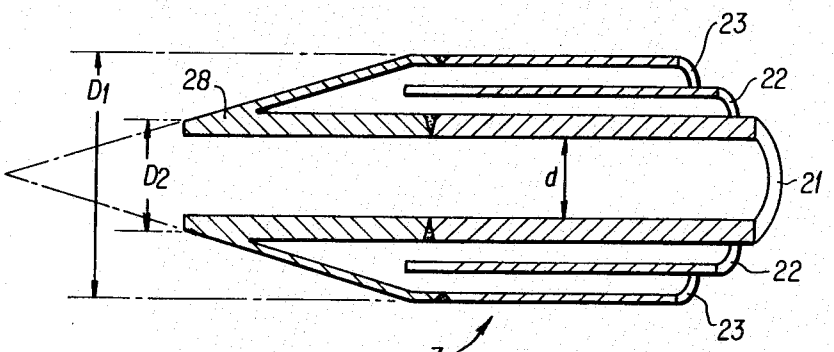
FIG. 7 is an enlarged view of one embodiment of the tip of the burner of the invention.

The burner of one embodiment of the invention (FIG. 7) is substantially the same as that in FIG. 6 in its cooling structure except for the cap fixedly welded to the fore end thereof. The invention employs a tapered cap 28 as shown in the drawing. The tapered cap 28 has at its base end an outer diameter $D_1$ similar to that of the burner body and is tapered to have an outer diameter $D_2$ at its fore end ($D_2<D_1$), although it has an inner diameter d which is uniform over its entire length. Thus, the outer diameter at the fore end of the burner is reduced by the provision of the tapered cap 28, minimizing the difference between $D_2$ and d. Consequently, the phenomenon that the jet flow 25 is expanded under the influence of the vacuum zone is suppressed, precluding the trouble of deposition or accumulation of fused ash on the inner surfaces of the blow pipe. However, this effect depends on the degree of reduction in the outer diameter ($D_1\rightarrow D_2$), so that it becomes necessary to define a suitable range of the diameter reduction.

Figure 8:
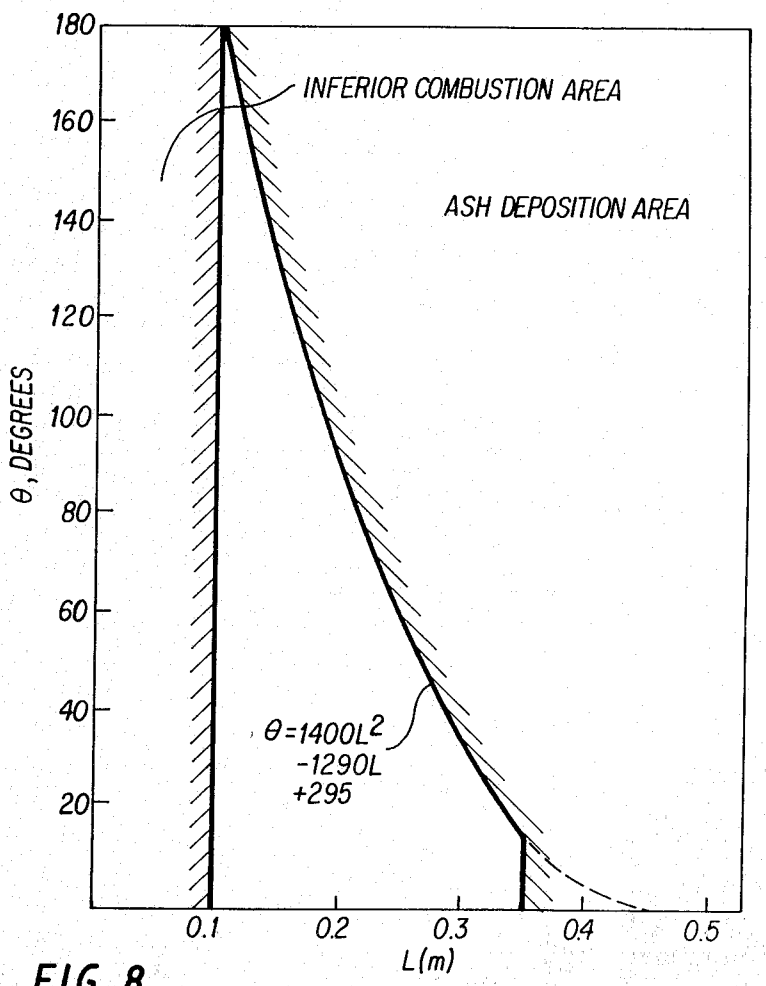
FIG. 8 is a graph showing the optimum range of taper angle $\theta$.

A study of the fused ash deposition for various taper angles ($\theta$ of FIG. 8) of the tapered cap 28 showed an influence of the setting position of the fore end of the burner (the distance L to an upstream position from the boundary surface 11*b* between the tuyere and the blow pipe). Namely, the shorter the distance L (the distal end of the burner located closer to the fore end of the blow pipe), the smaller became the amount of fused ash deposition. There was observed no ash deposition irrespective of the angle $\theta$ with a distance L smaller than 0.1 m. However, as discussed above, the ash deposition remained regardless of reductions in the angle $\theta$ with a distance larger than 0.35 m (350 mm).

Upon studying the relationship between $\theta$ and L on the basis of various data, it was found that the ash deposition occur easily on the upper side of the curve of FIG. 5 ($\theta=1400L^2-1290L+295$). Therefore, a preferable range which is free of the trouble of ash deposition can be defined as $\theta\leqq1400L^2-1290L+295$ and $L\leqq0.35$ m. However, as also discussed above, the combustion efficiency becomes lower in the range of $L<0.1$ m and can be enhanced by increasing L. Therefore, it is necessary to add the condition of $L\geqq0.1$ m. The ash deposition in the blow pipe begins if the distance L exceeds 0.35 m, destabilizing the combustion and the air flow C (hot blast) of FIG. 2, so that the setting of the condition of $L \leqq 0.35$ m is supported from the standpoint of both combustion efficiency and ash deposition.

Thus, there are set the condition of $$\theta \leqq 1400L^2 - 1290L + 295$$

$$0.1\ \text{m} \leqq L \leqq 0.35\ \text{m}$$

determining the taper angle at the fore end of the burner according to the position of the tip thereof, or alternatively determining the position of the distal end of the burner according to the taper angle at the fore end thereof.

With regard to the cooling structure of the burner according to the present invention, it is not limited to the construction as employed in the particular embodiment shown. For example, it is possible to add various alterations or modifications thereto by employing a double or quadruple cylinder construction or an air-cooling structure or by providing fins on the outer surface of the inner cylinder in such a manner as would not substantially hinder the flow of a cooling medium or the freedom of selecting a suitable material thereof.

The burner of the invention has a number of advantages as summarized below.

(1) The cooling of the burner lessens the frequency of replacement of the burner itself and contributes to the improvement of safety at the furnace.

(2) Owing to the elimination of the ash deposition and accumulation in the blow pipe, it becomes possible to improve the combustion efficiency of the pulverized fuel without accompanying adverse effects, permitting one to inject a large quantity of pulverized fuel in a stable manner.

(3) The burner can be replaced by a suitable one according to the kind of the pulverized fuel or changes in the injection condition.

Figure 9:
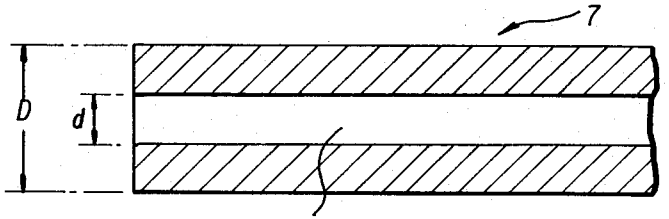
FIG. 9 is an enlarged view of the tip of the burner according to one variant of a second embodiment of the invention.
Figure 10:
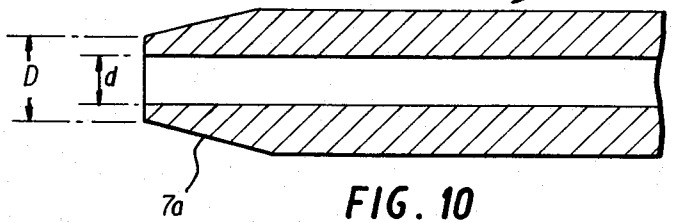
FIG. 10 is an enlarged view of the tip of the burner of another variant of the second embodiment of the invention.

FIGS. 9 and 10 illustrate examples of the burner according to the second embodiment of the present invention. More specifically, FIG. 9 shows a burner 7 of a simple cylindrical shape and having a circular central passage 7*b* for delivery of a pulverized fuel. FIG. 10 shows a burner 7 identical to that of FIG. 9 except that it includes a conical taper 7*a* at its fore end portion. In both embodiments, the burner 7 has an outer diameter D and an inner diameter d. In FIG. 10, the outer diameter D is that at the tip.

Experiments were conducted under the following conditions for the purpose of determining the optimum relations of D, d and Bi.

Pulverized fuel: Fine coal with about 32% wt of volatile matter

Fuel injection rate: 100 kg/hr

Hot blast air temperature: 1200° C.

Excess air ratio: 2.0

Figure 11:
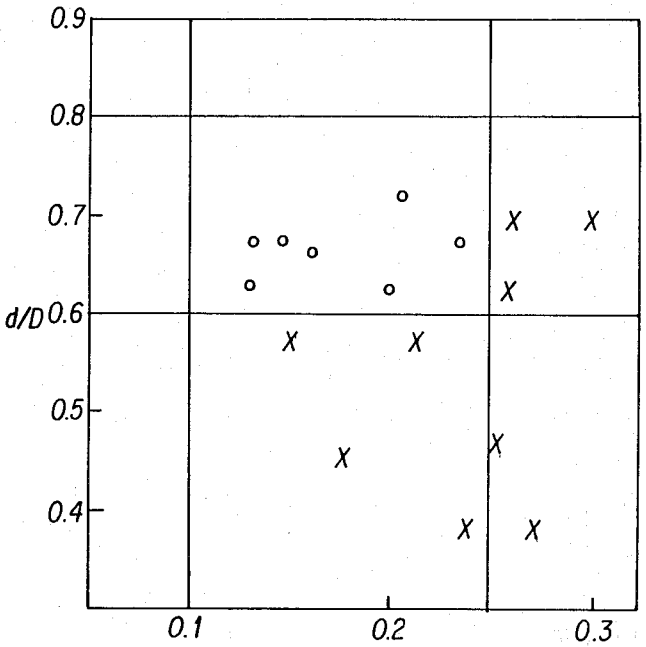
FIG. 11 is a graph showing the optimum ranges of d/D and D/Bi according to the invention.

Injecting position of burner: 297 mm upstream of boundary between tuyere and blow pipe FIG. 11 shows the results of experiments in which (D/Bi) and (d/D) were varied to observe the ash deposition under different conditions. In FIG. 11, the mark "O" denotes a case where no ash deposition or accumulation was recognized on the inner surface of the blow pipe while the mark "X" denotes a case which involved ash deposition or accumulation. As a result, it has been found that D/Bi should be smaller than 0.25 and d/D should be greater than 0.6. If D/Bi is less than 0.1, however, the burner becomes too small in outer diameter and thus weak in strength, and the injection quantity of the pulverized fuel becomes insufficient as compared with the flow quantity of hot blast air which is required to attain a given injecting velocity. On the other hand, if d/D exceeds 0.8, the burner becomes too small in wall thickness and thus weak in strength. Therefore, it is necessary to set the lower limit of D/Bi at 0.1 and the upper limit of d/D at 0.8.

If D/Bi exceeds 0.25, it forms a bluff body (an obstacle) against the flow of hot blast air. Consequently, there occurs non-uniformity to the flow within the blow pipe, generating Karman's vortex street downstream of the protruded portion of the burner and giving rise to distinctive, ash deposition on the blow pipe wall surfaces near Karman's vortex street.

If d/D becomes less than 0.6, it expands the vacuum zone 26 referred to hereinbefore in connection with FIG. 6, which can be a direct cause of the ash deposition and accumulation, and in some cases even encourages ash deposition at the fore end of the burner in the expanded vacuum zone, diverting the direction of pulverized fuel injection and as a result deflecting the flame to accelerate ash deposition on the wall surfaces of the blow pipe in the deflected direction.

The embodiment of the burner imposes no restriction on the construction of the burner as long as it satisfies the above conditions, and includes a burner which is additionally provided with an air-cooling or water-cooling mechanism, such as that of FIG. 6.

Figure 12:
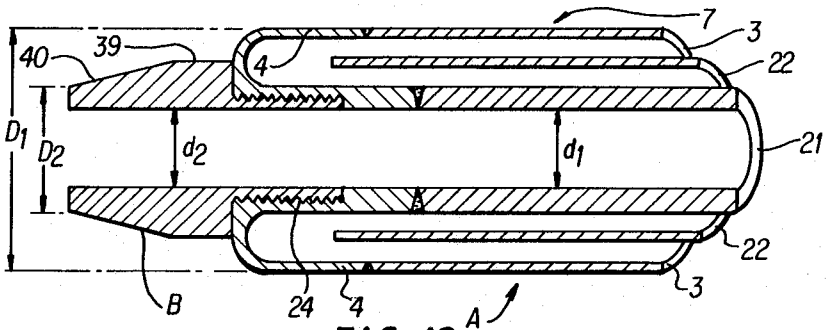
FIG. 12 is an enlarged view of the tip of the burner of the invention according to the third enbodiment thereof.

Referring to FIG. 12, there is shown in section a burner body proper A of a third embodiment which has a tip B threaded thereinto. The construction of the burner body A is substantially same as in FIG. 6 except for the feature that the cap 24 is provided with female screw threading 24' on its inner periphery. However, the exemplified joint construction of the cooling structure of the burner body A and the tip B should not be construed as restrictive in the present invention. For example, it is possible to add various alterations or modifications to the cooling structure, by employing a double or quadruple cylinder construction or an air-cooling structure or by providing fins on the outer surface of the inner cylinder in such a degree as would not substantially hinder the flow of a cooling medium, not to mention of the freedom of selecting the material. Further, the joint structure for connection to the tip B is not limited to the threaded system shown and may be a bayonet joint, a clamp joint or a wedge joint as long as it is able to be rapidly detachably connected.

The tip B, itself, should have an inner diameter $d_2$ which is not substantially smaller than the inner diameter $d_1$ of the inner cylinder 21, and should have a forwardly reduced diameter with an outer diameter $D_2$ at its fore end which is smaller than the outer diameter $D_1$ at the fore end of the burner body A, namely, $D_2 < D_1$. This is because, if $d_2 < d_1$, the particles which are fed through the burner strike the tip B and accelerate its abrasive wear. Moreover, it becomes difficult to eliminate the vacuum zone as described above in connection with FIG. 6 unless the condition of $D_2 < D_1$ is satisfied. In order to satisfy the foregoing conditions, it is necessary for the tip B to have on its inner side the relation of $d_1 \leqq d_2$ (preferably $d_1 = d_2$), and to have its diameter reduced toward its fore end on its outer side by the provision of stepped portions or a combination of stepped and tapered portions. In the particular embodiment shown, the tip B is formed with a fowardly tapered conical portion 40 contiguous to a cylindrical portion 39, the outer diameter of which is reduced stepwise as compared with the outer diameter of the burner body A. If desired, a taper or cone may be provided over the entire length of the tip B instead including the cylindrical portion 39.

The tip B is arranged to be detachable not only for replacement of a worn-out tip but also to permit one to change to a tip of suitable dimensions and shape according to the location of the tip end of the burner in the blow pipe, the kind of pulverized fuel used or the fuel injecting conditions, all of which have influences on the combustion efficiency of the pulverized fuel and the ash deposition. For example, an increase of the extension length of the tip B causes the jet flow angle of the injected fuel to narrow and lowers the amount of ash deposition, with a slight drop in the combustion efficiency. Therefore, the tip can be replaced in consideration of these conditions.

The present invention with the foregoing arrangement has a number of advantages as summarized below.

(1) The cooling of the burner reduces the frequency of replacement of the burner itself and contributes to job safety at the furnace.

(2) The tip is intimately contacted with the water-cooled cap which guarantees sufficient durability even if it is not of a special heat-resistant metal.

(3) The ash deposition and accumulation in the blow pipe is suppressed to a minimum, so that the combustion efficiency of the pulverized fuel can be improved without accompanying adverse effects and, accordingly, it becomes possible to carry out an injecting operation of a large quantity of pulverized fuel in a stable manner.

(4) The tip can be freely changed to an optimum one according to the kind of the pulverized fuel and the injecting conditions.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent is:

1. A method for injecting a pulverized fuel into a blast furnace having a tuyere having cooling means and a blow pipe connected to said tuyere at a boundary plane and an injecting burner protruding into said blowpipe, said method comprising the steps of:

introducing hot blast air through said blow pipe and into said tuyere;

introducing a pulverized fuel into said blow pipe through said injecting burner; and positioning an outlet of said injecting burner in a range of between 100 and 350 mm upstream from said boundary plane.

2. The method of claim 1 wherein said range is between 200 and 350 mm.

3. The method of claim 1 wherein said hot blast air is at a temperature of at least 950° C.

4. The method of claim 2 wherein said hot blast air is at temperature of at least 950° C.

5. The method of claim 4 wherein said outlet of said injecting burner is located in the vicinity of a longitudinal axis of said blow pipe.

6. An apparatus for supplying pulverized fuel to a blast furnace, comprising:

a tuyere having cooling means at one end of said furnace;

a source of hot blast air;

a blow pipe having one end connected to said source of hot blast air and a second end connected to said tuyere at a boundary plane;

an injecting burner having one end protruding into said blow pipe through a wall thereof, said injecting burner having a passage including an outlet spaced from said boundary plane by a distance of between 100 and 350 mm, wherein one end of said burner has a tapered outer configuration satisfying:

$$\theta \leqq 1400L^2 - 1290L + 295$$

$$0.1 \leqq L \leqq 0.35$$

wherein: $\theta$ is the taper angle at said one end of said burner, relative to a longitudinal axis of said passage, and L is the distance in meters between said boundary plane and said outlet of said passage.

7. The apparatus of claim 6 wherein said distance is between 200 and 350 mm.

8. The apparatus of claim 6 wherein said outlet is positioned in the vicinity of a longitudinal axis of said blow pipe.

9. The apparatus of claim 6 wherein the inner diameter of said blow pipe is between 130 mm and 180 mm.

10. In a furnace having a tuyere at one end, said tuyere having cooling means, a source of hot blast air, a source of pulverized fuel, a blow pipe having one end connected to said source of hot blast air and a second end connected to said tuyere at a boundary plane, an injecting burner having one end protruding into said blow pipe through a wall thereof, said burner further comprising at least one cylinder including an inner cylinder connected to said source of fuel flow, said passage having an outlet at said one end of said burner, said one end of said burner having a tapered outer configuration satisfying the following equation:

$$\theta = 1400L^2 - 1290L + 295$$

wherein: $\theta$ is the taper angle at said one end of said burner, relative to a longitudinal axis of said passage, and L is the distance in meters between said boundary plane and said outlet of said passage.

11. The furnace of claim 10 wherein said burner further satisfies the following equation:

$$0.1 \leqq L \leqq 0.35.$$

12. The furnace of claim 10 wherein said at least one cylinder includes at least one outer cylinder for providing a cooling fluid path between said inner and outer cylinders.

13. The furnace of claim 11 wherein said at least one cylinder includes at least one outer cylinder for providing a cooling fluid path between said inner and outer cylinders.

14. The furnace of claim 10 wherein said tapered configuration is conical.

15. In a furnce having a blow pipe, an injecting burner having one end protruding into said blow pipe through a wall thereof, said burner having a central passage extending to an opening at said one end for supplying pulverized fuel to said blow pipe, wherein said burner satisfies the following equation:

$$0.1 \leqq (D/Bi) \leqq 0.25,$$

wherein D is the outer diameter of said burner at said one end and Bi is the inner diameter of said blow pipe.

16. The furnace of claim 15 wherein said burner further satisfies the following equation:

$$0.6 \leqq (d/D) \leqq 0.8,$$

wherein d is the diameter of said passage.

17. The furnace of claim 15 wherein D is constant along adjacent said one end.

18. The furnace of claim 16 wherein D is constant along adjacent said one end.

19. The furnace of claim 15 wherein said outer diameter of said furnace is tapered towards said one end.

20. The furnace of claim 16 wherein said outer diameter of said furnace is tapered towards said one end.

21. The furnace of claim 18 wherein d is constant.

22. The furnace of claim 20 wherein d is constant.

23. In a furnace having a blowpipe, an injecting burner having one end protruding into said blow pipe through a wall thereof, said burner comprising:

at least one cylinder having an outer diameter $D_1$, said at least one cylinder including an inner cylinder connected to a source of pulverized fuel and forming a first flow passage for a solid/gas dual phase pulverized fuel flow, said inner cylinder having an inner diameter $d_1$;

a tip attached to said one end of said burner by detachable connecting means, said tip defining a second flow passage for said fuel and having a diameter $d_2$, the distal end of said tip having an outer diameter $D_2$, wherein:

$$d_1 \leqq d_2.$$

24. The furnace of claim 23 wherein:

$$D_2 < D_1.$$

25. The furnace of claim 23 wherein said at least one cylinder includes at least one outer cylinder for providing a cooling fluid path between said inner and outer cylinders.

26. The furnace of claim 24 wherein $D_2$ is constant along the entire length of said furnace.

27. The furnace of claim 24 wherein at least a portion of the length of said furnace is conical so that $D_2$ varies between a maximum and a minimum value, wherein the maximum value of $D_2$ is less than $D_1$.

28. The furnace of claim 23 wherein said detachable connecting means comprise mating screw threads.

* * * * *